US005813053A

United States Patent [19]

Pileggi

[11] Patent Number: 5,813,053

[45] **Date of Patent: *Sep. 29, 1998**

[54] SELF-RESTRAINING NECKTIE

[76] Inventor: Vincent J. Pileggi, 1847 Dillon Rd., Maple Glen, Pa. 19002

[ * ] Notice: The portion of the term of this patent subsequent to Aug. 31, 2010, has been disclaimed.

[21] Appl. No.: 89,375

[22] Filed: Jul. 12, 1993

Related U.S. Application Data

[63] Continuation of Ser. No. 818,081, Jan. 8, 1992, Pat. No. 5,239,707, which is a continuation-in-part of Ser. No. 774,796, Oct. 10, 1991, abandoned, which is a continuation-in-part of Ser. No. 724,835, Jul. 2, 1991, abandoned.

[51] Int. Cl.[6] ..... A41D 25/00; A41D 27/00

[52] U.S. Cl. ..... 2/145; 2/243.1; 24/49.1

[58] Field of Search ..... 2/244, 145, 146, 2/147, 148, 149, 150, 152 R, 152 A, 153, 155, 156, 157, 137, 243 R, 243 B; 24/49 CF, 49 R, 49 S, 49 TS, 56, 55

[56] References Cited

U.S. PATENT DOCUMENTS

| | | | |
|---|---|---|---|
| 1,273,261 | 7/1918 | Mills, Jr. . | |
| 1,291,090 | 1/1919 | Nuzum . | |
| 1,751,963 | 3/1930 | Weinschreider . | |
| 2,006,427 | 7/1935 | Wolfson . | |
| 2,090,816 | 8/1937 | Snider . | |
| 2,389,784 | 11/1945 | Kennedy . | |
| 2,588,576 | 3/1952 | Roop et al. . | |
| 2,652,569 | 9/1953 | Confino . | |
| 2,746,055 | 5/1956 | Gleason . | |
| 3,042,983 | 7/1962 | Reidler . | |
| 3,453,696 | 7/1969 | Mates . | |
| 3,639,916 | 2/1972 | Vaughn . | |
| 4,324,004 | 4/1982 | Smith et al. . | |
| 4,631,752 | 12/1986 | Heyman et al. . | |
| 4,827,536 | 5/1989 | Sung . | |
| 4,827,576 | 5/1989 | Prince . | |
| 4,835,821 | 6/1989 | Durante . | |
| 4,920,579 | 5/1990 | Swain . | |
| 4,972,523 | 11/1990 | Begg . | |
| 5,012,530 | 5/1991 | Ackerman . | |
| 5,073,987 | 12/1991 | Crosier . | |
| 5,095,546 | 3/1992 | Jones . | |
| 5,109,547 | 5/1992 | Abdallah | 2/145 |
| 5,239,707 | 8/1993 | Pileggi | 2/145 |

FOREIGN PATENT DOCUMENTS

| | | |
|---|---|---|
| 158526 | 8/1954 | Australia . |
| 1023486 | 12/1952 | France . |
| 2610796 | 8/1988 | France . |
| 822985 | 10/1951 | Germany . |
| 2156395 | 5/1973 | Germany . |
| 2843826 | 4/1980 | Germany . |
| 291166 | 1/1950 | Switzerland . |

OTHER PUBLICATIONS

Affidavit of Paul Winston.
File Wrapper Excerpts —SN 07/724,853.
File Wrapper Excerpts —SN 07/774,796.
File Wrapper Excerpts —US Pat 5,239,707.
File Wrapper Excerpts —US Pat 5,109,547.
Vogue/Butterick's Fine Sewing "Interface Like An Expert," pp.68–72 (1990).
Ty–Button Tie, Inc./Abdallah License Agreement.
Affidavit of Paul Winston signed May 2, 1994, filed with the United States District Court District of New Jersey, Civil Action No. 93–2172 (JCL).

*Primary Examiner*—Jeanette E. Chapman
*Attorney, Agent, or Firm*—Synnestvedt & Lechner

[57] ABSTRACT

The present invention is directed to improved apparatus and method for providing a necktie restraining apparatus. The present invention employs a fusion cloth to stiffen necktie material so that it may be employed as vertical and horizontal members on an apparatus for securing a four-in-hand necktie to a shirt button while automatically adjusting to compensate for changes in the amount of slack on the necktie. An improved method of manufacture of such a necktie restraint apparatus is also disclosed.

4 Claims, 4 Drawing Sheets

SELF-RESTRAINING NECKTIE

The present application is a continuation of Ser. No. 08/818,081 filed Jan. 8, 1992, U.S. Pat. No. 5,239,707, which is continuation-in-part of U.S. patent application Ser. No. 774,796, filed Oct. 10, 1991, now abandoned, which is a continuation-in-part of U.S. patent application Ser. No. 724,835, filed Jul. 2, 1991, now abandoned.

BACKGROUND OF THE INVENTION

1. Field of the Invention

The present invention relates to an improved self-restraining four-in-hand necktie and apparatus to anchor a four-in-hand necktie to a shirt, so that it remains properly restrained and centered when adorned, and methods of manufacture therefor.

2. Description of the Prior Art

A conventional "four-in-hand" necktie is tied about the neck with a knot at a shirt collar and generally has an outward facing section passing down the shirt front to conceal shirt buttons and a somewhat narrower tail section which hangs down from the knot and is concealed by the outward facing section. Normally, a wearer might use one of a number of possible methods to control a tie, including: letting both the outward section and the tail section hang free; passing the tail section through a manufacturer's label regularly provided on the back of the outward facing section so that the two sections of the tie hang as a unit; or attaching the two sections to the shirt by use of various forms of jewelry, such as a tie-tack, a tie bar or a tie pin to keep the tie in place.

The problem with the non-restrained methods of wearing a tie mentioned above is that the tie sections hang free. This not only regularly presents disarray in appearance, but the tie sections frequently interfere with work, are soiled or ruined by dragging through food or other staining material, and may be quite hazardous if accidentally caught in a doorway or machinery.

The use of jewelry holding devices is common, but also suffers from a number of drawbacks. First, these devices often pass in and out of favor depending on preference and fashion trends. Second, they are often expensive and regularly cause damage to the fabric by creating permanent holes, creases, and blemishes in the tie. Finally, these jewelry devices anchor the tie to the shirt and often do not permit vertical movement of the tie relative to the shirt. Torso movements of the wearer cause the anchored tie to pull on the knot causing displacement of the knot and general disarray so as not to present an elegant appearance.

Not surprisingly, a number of solutions have been proposed to attempt to avoid the above problems, but none is believed wholly satisfactory. U.S. Pat. No. 4,920,579 to Swain describes an apparatus to restrain necktie tails of a four-in-hand tie at the front of the shirt by relying on the manufacturer's sewn-in-place label on the back of the outward facing section and a flat plastic loop threaded through that label and attached to buttons on the shirt front. The plastic loop is somewhat stiff and has button holes at each end with a fixed distance between them. This arrangement is believed to have numerous drawbacks, including that it is awkward to employ—requiring keeping track of the loop, re-positioning the loop each time a new tie is worn, and often re-tying of the tie to center the device properly. Further, this device relies on the distance between buttons fixed by the manufacturer of the shirt which is not always the same from shirt to shirt. Moreover, this device may cause tie damage through constant pulling on the manufacturer's label—a use for which the label is not designed. Finally, the stiff plastic loop may prove uncomfortable to wear.

Another approach is described in U.S. Pat. No. 4,827,576 to Prince, Jr. There a button-slot neck tie fastener is permanently affixed to the manufacturer's label and a stiff portion having button slots is affixed to a shirt button. Apparently the tie's vertical movement relative to the shirt is permitted by the slot engaging the button. This device is believed to suffer from most of the same drawbacks as the Swain device, and may have the additional problem of possibly wearing out the shirt front where it contacts the device and the button stitching—thus possibly damaging both the tie and the shirt.

Still another solution to keeping a conventional tie in proper position is disclosed by U.S. Pat. No. 4,972,523 to Begg. Begg contemplates the use of complementary VELCRO®-type loop-and-hook material, with a first element thereof on the back of the outward facing section and a second element thereof on a loop around the tail section. The second element has a slot on its opposite side for engagement with a shirt button. The two hook-and-loop elements engage each other to hold the tie in position and the tail section of the tie is threaded through the loop. Although this arrangement solves some of the problems presented by the Swain and Prince devices, its separate elements are believed to be somewhat awkward to use and the loop element may be prone to loss. More importantly, this design does not allow vertical movement of the tie relative to the shirt to follow movement of the torso of the wearer—leading to some of the same presentation problems as conventional jewelry restraining devices.

Applicant's device disclosed in the parent application solves all of these problems. The invention disclosed in the parent application employs a tie restraint apparatus with a vertical member attached at its top and bottom to the back of the front section of the tie, and a horizontal member which surrounds the vertical member and slides between the vertical member's top and bottom positions. The horizontal member includes one or more openings in it which attach to buttons on the shirt.

In operation, once the necktie is tied in a conventional manner, the horizontal member is easily slid into a position on the vertical member which aligns with an opening with a button on the shirt. The button is then secured within the opening to provide an anchor for the tie. The concealed tail section of the tie may be inserted through the horizontal member to keep it safely secure. This entire apparatus may be permanently affixed to a tie and constructed from material identical or similar to the tie's so that it is completely concealed from vision and its presence is not evident to the wearer.

The attachment of the horizontal member to the shirt has proven to be a very secure method of retaining the tie in place. This is due in part to the free movement of the horizontal member on the vertical member which assures that the tie always stays in a straight and low-stress orientation. Moreover, the invention of the parent application is extremely simple and reliable in operation, may be instantly attached without complicated positioning of the tie relative to shirt buttons, may be inexpensively incorporated as original equipment on any conventional tie, and, due to its automatic adjustability, always presents an orderly appearance regardless of a wearer's torso movement.

Despite the many advantages of the invention of the parent application, further improvements are considered to be possible, particularly in the method of manufacture.

Although the invention of the parent application may be constructed from virtually any material, it has been determined that the apparatus functions significantly better if the material is stiffened to provide for smoother sliding between the vertical and horizontal members. Although this can be readily accomplished by employing a relatively stiff fabric for the apparatus, this tends to make the apparatus stand out from the tie in an undesirable manner.

A problem which then emerges is how to employ the same material as the tie itself, so as to camouflage the apparatus, while providing a suitably stiff apparatus. Experimentation with lining the tie material has proven somewhat effective to this end, but is viewed to be far too cumbersome for full scale production.

Accordingly, it is a primary object of the present invention to provide a fabric apparatus for maintaining a necktie in place which is stiffened to assure smooth operation.

It is another object of the present invention to provide a method of manufacture of such an apparatus which readily provides full camouflage of the apparatus during use.

It is a further object of the present invention to provide a method of manufacture of a necktie restraining means which is as simple and straightforward as possible to be readily adapted for full scale production.

These and other objects of the present invention will become evident from review of the following specification.

SUMMARY OF THE INVENTION

The present invention provides improved necktie, necktie apparatus and method for construction of apparatus for anchoring dangling sections of a necktie to a shirt.

As an improvement to the tie restraint apparatus disclosed in the parent application, the present invention provides a means of stiffening the vertical and horizontal members of the apparatus so that they will move freely with respect to one another. In the preferred embodiment, the tie restraint apparatus is constructed from the identical cloth as the tie itself; prior to assembly, a "fusion cloth" is then employed to bond permanently with the vertical and/or horizontal members to provide the desired amount of stiffness.

In the method of manufacture disclosed, fusion cloth is applied to extended sheets of material prior to trimming to the dimensions of the tie restraint apparatus. Once stiffened in this manner, the material may be readily manipulated to construct the apparatus. In this manner the restraint apparatus may be constructed from the exact same material as the tie itself, thus being fully camouflaged, while being extremely easy to attach to the tie.

The present invention provides a simple and effective means of constructing a secure anchor for a tie which presents the best possible appearance at all times while keeping the tie clean, safe and out of harm's way.

DESCRIPTION OF THE DRAWINGS

The operation of the present invention should become apparent from the following description when considered in conjunction with the accompanying drawings, in which.

DETAILED DESCRIPTION OF THE INVENTION

The invention disclosed in the parent application is an improved apparatus and method for securing a necktie to a shirt to prevent it from being dislodged from a centered position. The present invention is an improved method of producing such an apparatus so that it functions smoother and is easier and cheaper to produce.

Figure 1:
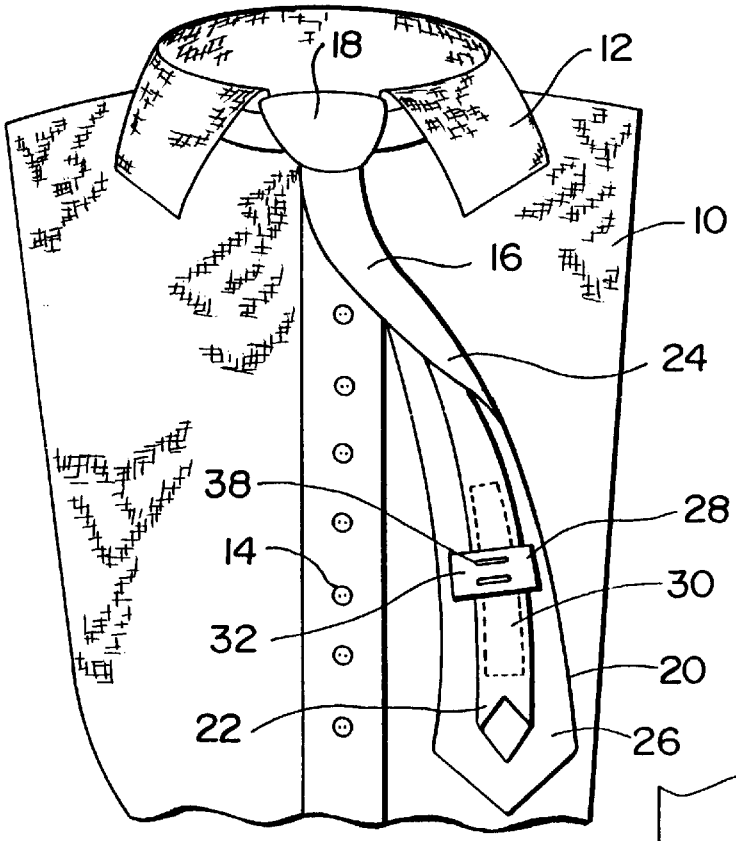
FIG. 1 is an isometric view of the tie restraint invention of the parent application shown attached to a conventional necktie.
Figure 2:
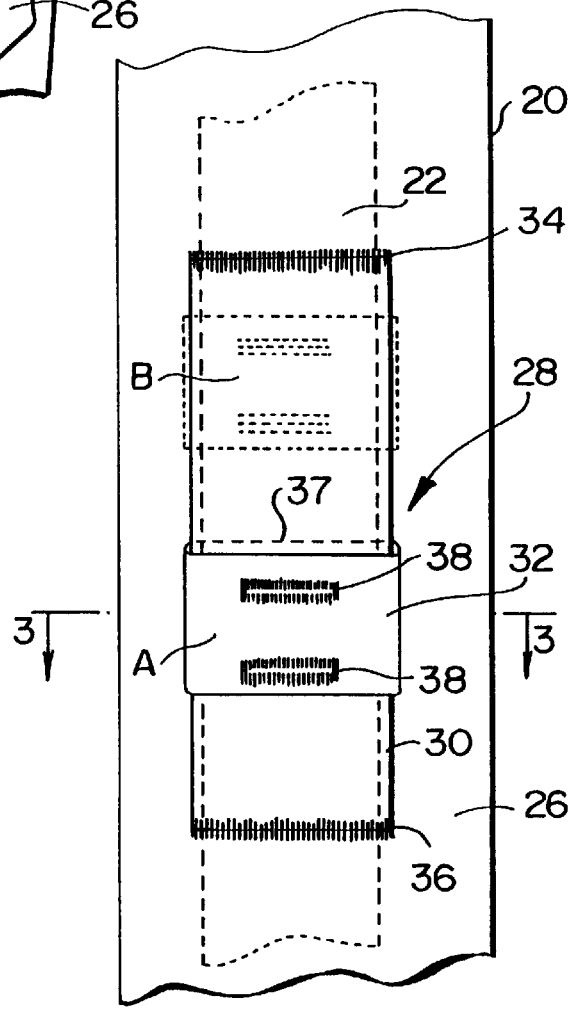
FIG. 2 is an enlarged sectional view of the tie restraint invention of the parent application attached to a necktie, including showing a horizontal member of the present invention in a first position and a second position (in phantom), and a tail section of the necktie shown in phantom.
Figure 3:
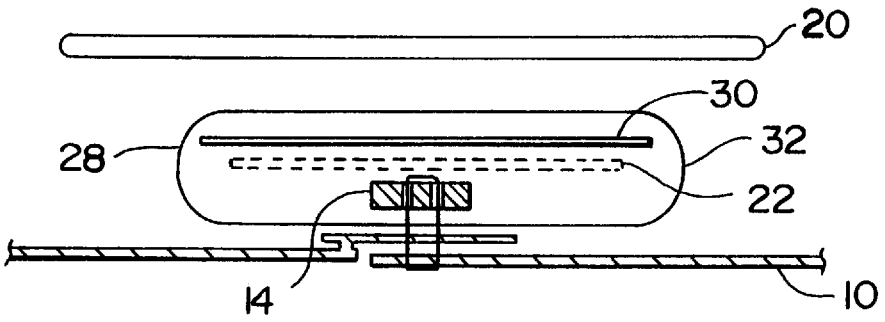
FIG. 3 is a cross-sectional view along line 3—3 of FIG. 2, adding a representation of the present invention in relative orientation with a shirt and shirt button.

The tie restraint apparatus invention of the parent application is shown in FIGS. 1 through 3. Shown in FIG. 1 is a conventional shirt 10 having a collar 12 and a row of buttons 14 down its center. As is known, a conventional four-in-hand tie 16 is tied around the collar 12 and fashioned into a slip knot 18 which is pulled snugly around the a wearer's neck (not shown). It should be appreciated that the invention of the parent application and the present invention function equally well with respect to "clip on" ties or similar devices which may not be tied in a traditional slip knot. Once tied or applied, the tie 16 generally leaves two sections hanging down from the knot 18—an outward facing section 20, and a normally concealed tail section 22. As shown, the outward facing section 20 has both a front 24 and a back 26. Necktie securing apparatus 28 is shown attached to the back 26 of the outward facing section 20 and surrounding the tail section 22.

Referring to FIGS. 1 and 2, the apparatus 28 comprises a vertical member 30, which is attached to the back 26 of the outward facing section 20, and a horizontal member 32. The vertical member 30 is preferably a length of flexible fabric material with a top end 34 and a bottom end 36. The fabric may be attached to the back 26 through any convenient means, including with sewing, glue or other adhesives, hook and loop fasteners, pin or snap fasteners, or any other known fastening means. The preferred attachment method is shown in FIG. 2, where the length of fabric is sewn to the back 26 only at its top and bottom ends 34, 36.

The horizontal member 32 is then attached to the vertical member 30 in a manner which permits the horizontal member 32 to be adjusted into various positions along the vertical member 30. As is shown in FIG. 2, preferably the horizontal member 32 is constructed out of a length of material which is attached to itself around the vertical member 30, such as through sewing 37, adhesive, or other fastening means. In this manner, the horizontal member 32 may be moved to any position between the ends 34, 36. This may alternatively entail a semi-rigid C-shaped horizontal member 32 which partially surrounds the vertical member so to prevent it from falling off. An example of the mobility of the apparatus is shown in FIG. 2, where the horizontal member 32 is moved from a first position A to a second position B (in phantom).

The horizontal member 32 is provided with one or more openings or "button holes" 38 therein to provide means to attach the horizontal member 32 to a button 14 on the shirt 10. More than one opening 38 may be helpful to assist in the alignment of the apparatus. Alternatively, other attachment means between the horizontal member 32 and a button 14 may be employed within the general scope of the contemplated invention, such as substituting for a button hole any other opening (e.g. in the form of a loop of thread or a hook attached to a small chain) affixed to the horizontal member 32 which may engage around or behind a button 14.

The method of operation of the apparatus may be understood by review of FIGS. 1 through 3. A tie 16 including the apparatus 28 may be tied in any known manner. So long as a flexible material similar to the tie's material is used to create the vertical and horizontal members 30, 32, virtually no difference should be noticed in the normal procedure of tying the tie 10.

Once tied, the horizontal section 32 may then be slid along the vertical section 30 to align an opening 38 with a suitable button 14. Once aligned along the vertical member 30, the horizontal member 32 is attached with one of the openings 38 to one of the shirt buttons 14. The tail section 22 may then be inserted through the horizontal member 32 to complete the positioning of the tie. Without departing from the present invention, it is important to note that the sequence of these steps may be performed in any order by personal preference (i.e. the tail may be inserted and then the horizontal section may be aligned and attached to a button). The final orientation of the apparatus 28 and a shirt 10 and shirt button 14 is shown in FIG. 3.

In order to provide the maximum range of adjustability while being worn, the horizontal member 32 should be initially positioned midway between the top and bottom of the vertical member 30 when first adorned. The recommended relative position is shown in FIG. 1. This orientation may be easily adjusted at any time by the wearer simply by relocating the horizontal member 32 onto a different button.

It should be appreciated that the vertical member 30 and the horizontal member 32 may be constructed from any desired material. Appropriate materials include those natural and man-made fibers normally employed in tie construction, such as cotton, polyester, and silk, as well as virtually any other material which can be securely anchored to a tie. Preferably, the apparatus should be constructed from a durable material or materials which allow the vertical member 30 and the horizontal member 32 to slide easily relative to one another, such as polymer fabric (which may also be relatively inexpensive), or a material which complements the quality of the material in the tie (e.g. silk).

In its preferred construction, the vertical member 30 should comprise a length of material which will cover a span of at least two buttons on a conventional dress shirt. This generally entails a length of within 4½ to 7 inches. Preferably, the vertical member 32 is at least four and a half (4½) inches long. The vertical member should be anchored near the end of the outward facing section 20 of the tie; anchoring the bottom end 36 3 to 6 inches from the tie's tip is suitable for most applications. The horizontal member 32 should be wide enough to anchor to a button 14 while comfortably surrounding the tail section 22 and the vertical member 30. For most present tie dimensions, a width of 1½ to 2 inches provides sufficient room to permit easy sliding adjustment between the vertical member 30 and the horizontal member 32.

The tie restraint apparatus securely anchors the tie 16 to the shirt 10 and keeps it centered and close to the shirt in all forms of activities. However, the apparatus is completely concealed and is in no way noticeable to the wearer or others. Unlike some previous devices, the restraint apparatus permits the necktie 16 to slide relative to its anchor point, thus permitting the tie to automatically adjust to increases and decreases in slack of the tie sections 20, 22, such as when passing between a seated and standing position. This provides the best presentation of the tie at all times without inconveniencing the wearer.

The present invention provides an improved method of constructing the tie restraint apparatus 28. It has been determined that the tie restraint apparatus may be improved significantly if the vertical member 32 and the horizontal member 30 are provided with some degree of stiffness. This helps improve the sliding interface between the two members and may improve the durability of the apparatus 28 as a whole.

Although use of certain materials, such as some polyesters and nylons, may inherently provide such stiffness and ease in movement between the horizontal member 32 and the vertical member 30, these materials are not common as the outside material in finer quality ties. Since it is desirable to manufacture the apparatus 28 from the same material as the tie itself to improve camouflage of the apparatus, when a tie material such as silk is employed the apparatus 28 should be lined to achieve necessary stiffness and durability.

Although it is possible to line the tie restraint apparatus 28 by wrapping the exposed material around a cotton or polyester lining fabric, in a manner similar to a conventional construction technique for ties, this has proven to be less than fully satisfactory. First, even though this procedure does stiffen the apparatus 28, it tends to add unnecessary bulk to the apparatus which may hinder the free movement of the horizontal member 32. Second, it has been determined that the manufacture of the apparatus 28 is far more intricate, and the process of lining the apparatus 28 tends to be far more difficult, than the manufacture and lining of an entire tie.

Accordingly, the present invention employs means to stiffen the apparatus material itself. This may be accomplished in a variety of ways, such as through binder-bonding, and thermal bonding with a fusion cloth. Binder-bonding involves treating apparatus 28 fabric with a chemical agent, such as a starch or polymer, which will make the fabric more rigid. Although satisfactory results may be possible with such techniques, many such treatments, such as starching, tend to be somewhat temporary and may not withstand washing or dry cleaning.

The preferred embodiment of the present invention involves thermal bonding through use of a "fusion cloth" bonded directly to the apparatus 28 material. Such fusion cloths are commonly employed today in a variety of manufacturing processes, such as lining slacks and jackets to provide "permanent" creases or to cover padding. Such fusion cloths are commercially available from a number of sources, such as under the trademark PELLON® from Freudenberg Nonwovens of Chelmsford, Mass. This product is available in a wide variety of cloth grades and types of adhesives.

Figure 4:
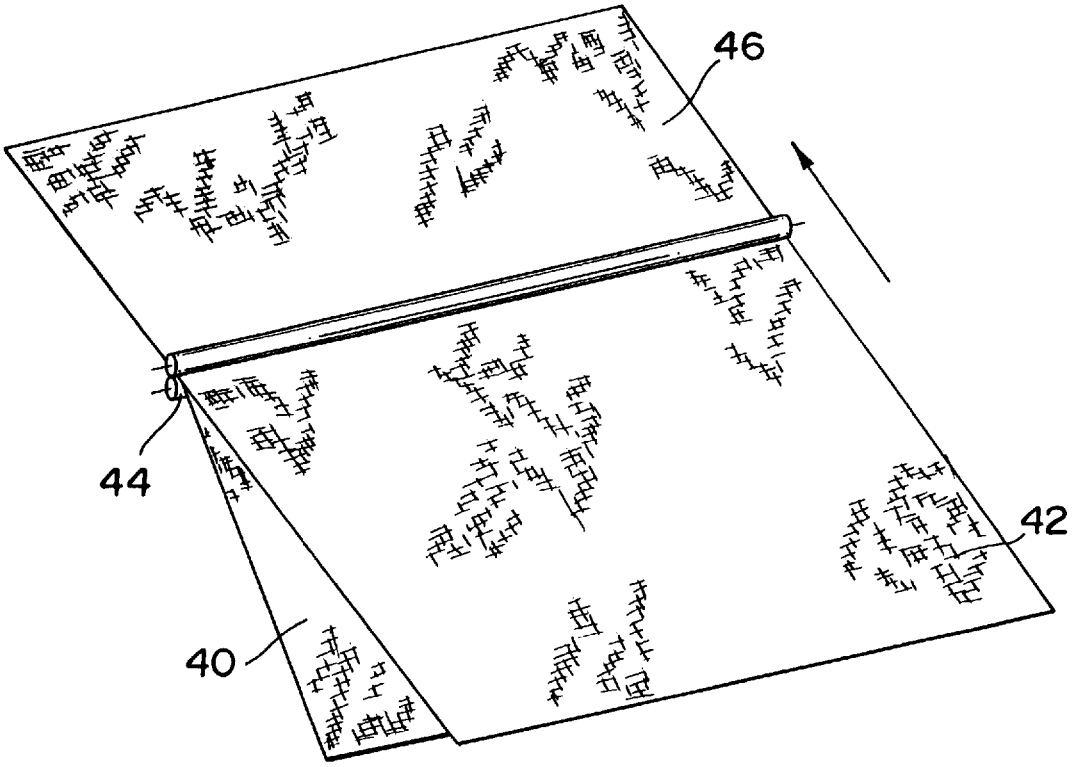
FIG. 4 is a schematic representation of the process of bonding material for the tie restraint apparatus to stiffening fusion cloth material.
Figure 5:
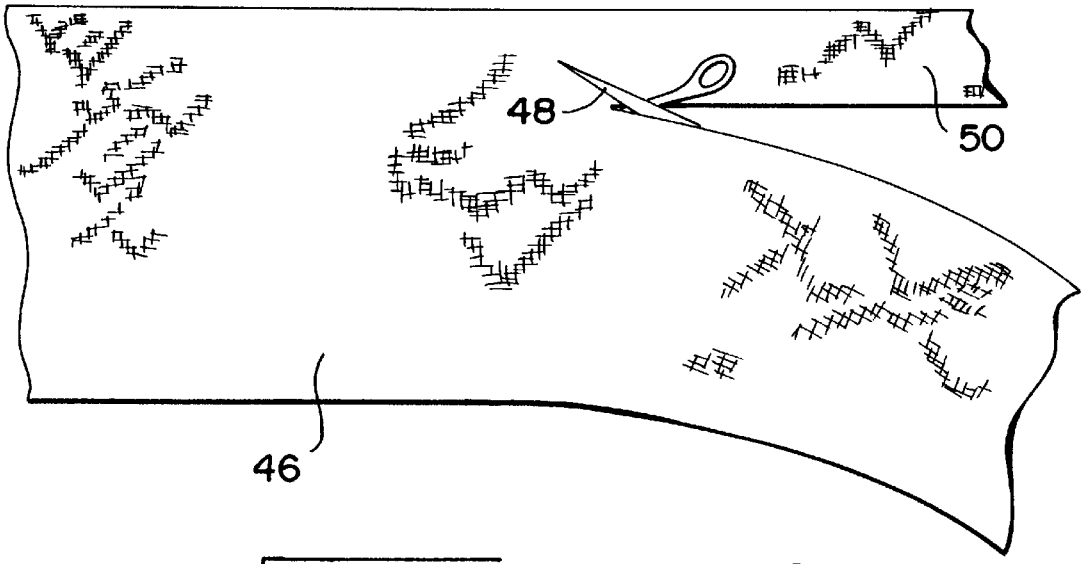
FIG. 5 is a schematic representation of the bonded cloth created through the process shown in FIG. 4 being trimmed into lengths of cloth for creation of the tie restraint apparatus.

Fusion cloth may be applied in a variety of ways. As is shown in the schematic diagram of FIG. 4, in full scale production a full sheet of original tie/apparatus material 40 is positioned under fusion cloth material 42. The two materials 40, 42 are then pulled through a fusion press 44. The fusion press 44 is essentially a series of heated rollers which activate the adhesives in the fusion cloth 42 and, through pressure applied over a set period of time, permanently bind the fusion cloth 42 to the original material 40. One such unit is sold by A. S. Technologies of Roswell, Ga., as a model 6500 Series. Through this process a stiffened cloth 46 is created. It should be appreciated that a variety of other means may be employed to bond the material 40 to the fusion cloth 42, such as through conventional ironing processes.

For use with a 100% silk material, it has been found that the best results may be possible by employing a "heavy" grade of fused cloth in the vertical member 30, and a "heavy" or "extra heavy" grade of fused cloth in the horizontal member 32. The bonding process occurs at a temperature of approximately 250°–290° F. against the fusion cloth and approximately 270°–300° F. against the tie material. Pressure is applied over a period of approximately 20–30 seconds. The particular parameters for each application may vary depending on the type of material 40, grade of fusion cloth 42, type of adhesive, and particular environmental conditions. Each particular material/fusion cloth combination should be thoroughly tested before production, including performing sampling of anticipated washing or dry cleaning conditions.

Once the stiffened cloth 46 is created in this manner, it may be easily worked to form the tie restraint apparatus 28. In the preferred process shown in FIGS. 5 through 8, stiffened cloth 46 is created in a wide sheet which is then trimmed using shears 48 or other known cutting means, such as an electric cutting knife, into elongated lengths of cloth 50 of an appropriate width to form either the vertical member 30 or the horizontal member 32. The time for the process of trimming may be vastly decreased by stacking the stiffened cloth 46 into layers and cutting multiple layers simultaneously. Many commercially available electric cutting knives can accurately cut material up to 3 inches in thickness using this technique.

Figure 6:
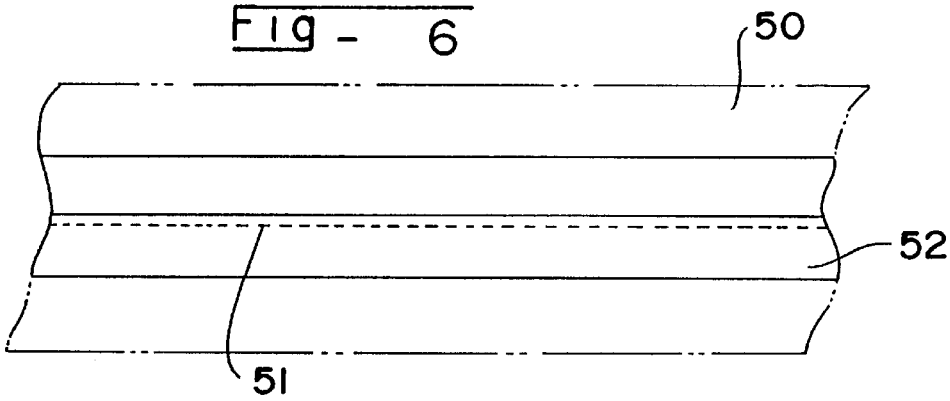
FIG. 6 is a plan view of a length of cloth as produced in the process shown in FIG. 5, with the length of cloth being shown in a flat orientation (phantom) and folded and stitched into a long tube of material.

As is shown in FIG. 6, the length of cloth may then be folded and stitched 51 or glued lengthwise into a long tube 52 which is the desired final width of either the vertical member 30 or the horizontal member 32. For a more finished appearance, either before or after the trimming steps described below, the tube 52 may then be reversed or turned inside out to conceal its stitches on the inside.

Figure 7:
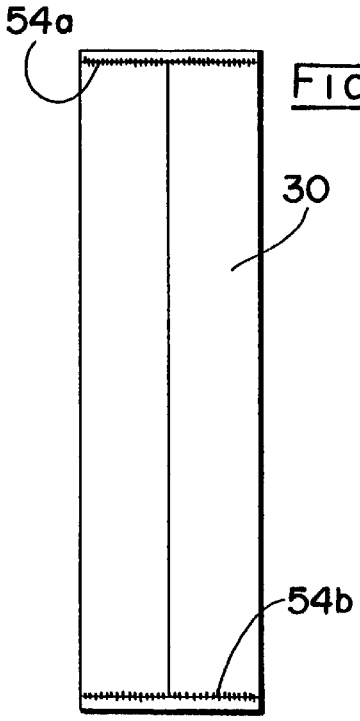
FIG. 7 is a plan view of a section of a tube of material as produced in the process shown in FIG. 6, reversed and cut and finished to the correct length to form a vertical member of the tie restraint apparatus.

As is shown in FIG. 7, the tube 52 for the vertical member 30 is then trimmed to the correct length and its ends 54*a*, 54*b* can be turned over for mounting to a tie in the manner described above and shown in FIGS. 1 and 2. For most applications a length of approximately 6 inches is considered optimal.

Figure 8:
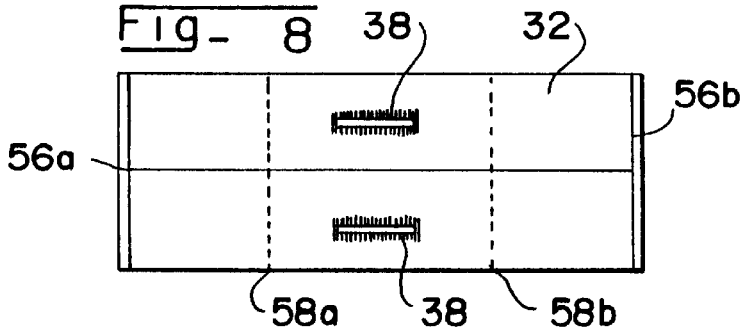
FIG. 8 is a plan view of a section of another tube of material as produced in the process shown in FIG. 6, reversed and cut and finished to the correct length to form a horizontal member of the tie restraint apparatus.

As is shown in FIG. 8, the tube 52 for the horizontal member 32 is then trimmed to the correct length, exposing two ends 56*a* and 56*b*. Either before or after trimming, button holes 38 may be applied to the horizontal member 32. At this stage, the horizontal member 32 may be folded (along lines 58*a* and 58*b*) and mounted in the manner described above and shown in FIGS. 1 through 3 by joining ends 56*a* and 56*b* to form a sleeve. For further improved operation, the horizontal member 32 may be ironed or otherwise treated to form a clean crease along lines 58*a* and 58*b*.

Due to the use of stiffened cloth 46, the entire manufacturing procedure for making and assembling the tie restraint apparatus 28 is greatly simplified and expedited. The stiffened cloth 46 tends to be easier to work with and more forgiving than most untreated tie material 40. More importantly, the stiffened cloth 46 does not require any lining or further treatment—greatly reducing labor costs in assembling the apparatus 28.

Figure 9:
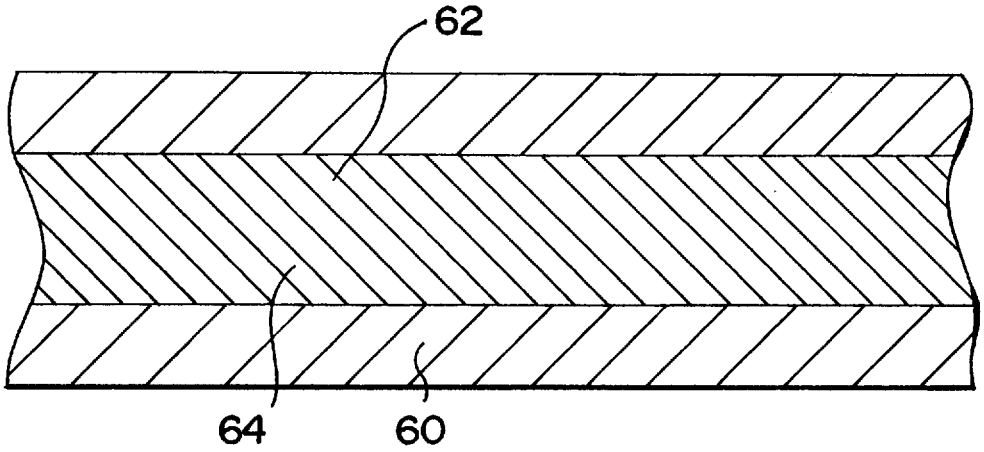
FIG. 9 is a plan view of a strip of cloth and a double faced fusion cloth material employed in another method of manufacture of the present invention.
Figure 10:
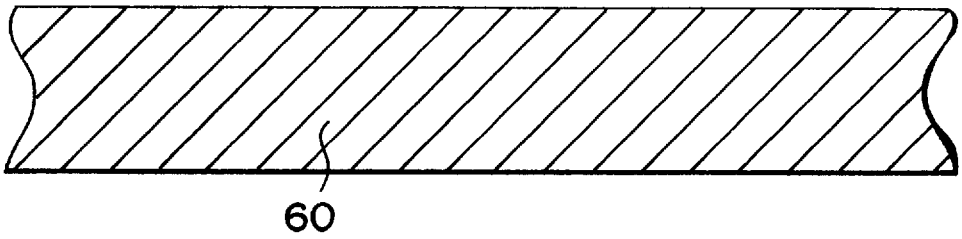
FIG. 10 is a plan view of the strip of cloth shown in FIG. 9 bonded to itself using the double faced fusion cloth.

A further modification of the present invention is shown in FIGS. 9 and 10. Instead of creating an entire sheet of stiffened fabric, as was described above, this method employs a strip of cloth 60 formed from tie material of approximately twice the width of a finished vertical or horizontal member. A double sided fusion cloth or "tape" 62, having adhesive on both its top face 64 and bottom face (not shown), is then laid down the middle of the strip 60. Such fusion tape material having adhesives on both of its faces is commercially available from a number of sources, including from Singer Sewing Company of Edison, N.J. The fusion tape 62 should be approximately the same width as the final desired width of the vertical or horizontal members. For most applications a fusion tape width of 1.5 to 2.0 inches is suitable.

As is shown in FIG. 10, each side of the strip of cloth 60 is folded over the fusion tape 62 and sealed into this folded position by the sealing or ironing method described previously. The use of double faced fusion tape forms a secure unit which may then be readily trimmed to the correct lengths for use as vertical or horizontal members. It has been found that the vertical and horizontal members may be formed from the same strip of cloth 60 by merely cutting to the appropriate length and sewing in the manner described above and shown in FIGS. 7 and 8.

This technique of forming the vertical and horizontal members is faster, and may be more reliable, than the method described above. The double faced fusion tape 62 completely eliminates the need for lengthwise sewing of the vertical or horizontal members—making the process faster and providing even thinner and smoother horizontal and vertical members. Strips of stiffened fabric can be created using this method up to 25 feet or more in length.

The use of double sided fusion tape also may be employed to anchor the restraint apparatus to the tie itself to form the sleeve. Instead of sewing the vertical member to the tie, it is believed possible to secure the vertical member to the tie by positioning double sided fusion tape at the vertical member's top and bottom and ironing it into place. This construction technique is of particular interest for making the tie restraint apparatus available as an after-market device which may be applied by the consumer. Although somewhat more cumbersome, double sided fusion tape may also be used to anchor the horizontal member to itself.

The present invention provides a significant improvement in time and expense in creating the tie restraint apparatus 28. Moreover, the present invention results in an improved apparatus which is more durable and functions smoother than was previously considered possible. This allows the apparatus to be reliably constructed from virtually any tie material—reducing material costs and assuring that the tie restraint apparatus is completely concealed from view.

Although particular embodiments of the present invention are disclosed herein, it is not intended to limit the invention to such a disclosure and changes and modifications may be incorporated and embodied within the scope of the following claims.

What is claimed is:

1. A self-restraining necktie which comprises:

a necktie made from an original material having an outward facing section with a front and a back and a tail section, said tail section being oriented behind said outward facing section in normal wearing position;

a vertical member formed from a sheet of stiffened cloth, said sheet of stiffened cloth made by bonding a sheet of the original material to a fusion cloth;

a horizontal member having at least one buttonhole, therein formed from said sheet of stiffened cloth by cutting an elongate length from said stiffened cloth, folding said cut length lengthwise, sealing said folded cut length to form a tube, and cutting the tube perpendicular to its length; and wherein the horizontal member is slidably secured around the vertical member and the vertical member is attached to the rear of the outward facing section.

2. The apparatus of claim 1 wherein the vertical member comprises a length of stiffened fabric having a top end and a bottom end, the fabric being affixed to the back of the outward facing section at its top and bottom ends; and the horizontal member comprises a band which is attached to itself to surround the vertical member completely.

3. The apparatus of claim 2 wherein the vertical member and horizontal member are cut and formed from a source of original material, and wherein fusion cloth is bonded to the original material prior to the vertical member and horizontal members being cut therefrom.

4. A tie restraint apparatus for use on a necktie made from an original material, having an outward facing section, including a front and a back, and a tail section, said apparatus comprising:

a vertical member attached to the back of said outward facing section;

a horizontal member having at least one buttonhole therein slidably attached to said vertical member;

said horizontal and said vertical members being formed from a sheet of the original material which has been stiffened by bonding an original material to a fusion cloth to form a sheet of stiffened cloth;

forming the vertical member from said stiffened cloth;

cutting an elongated length of material from said stiffened cloth;

folding said cut length of material lengthwise;

sealing said folded cut length of material to itself to form a tube;

cutting the tube perpendicular to its length to form said horizontal and vertical members;

joining the horizontal member around the vertical member so that the horizontal member will slide freely relative to the vertical member; and attaching the vertical member to the back of the outward facing section of the tie.

* * * * *